United States Patent [19]
Alpers
[11] 4,288,049
[45] Sep. 8, 1981

[54] REMOTE TARGETING SYSTEM FOR GUIDED MISSILES

[75] Inventor: Frederick C. Alpers, Riverside, Calif.

[73] Assignee: The United States of America as represented by the Secretary of the Navy, Washington, D.C.

[21] Appl. No.: 112,494

[22] Filed: Jan. 19, 1971

[51] Int. Cl.³ ..... F41G 7/28
[52] U.S. Cl. ..... 244/3.14
[58] Field of Search ..... 244/3.14, 3.19, 3.22

[56] References Cited

U.S. PATENT DOCUMENTS 3,141,635 7/1964 Davis et al. ..... 244/3.19
3,636,411 1/1972 Bulloch ..... 244/3.22

*Primary Examiner*—Charles T. Jordan
*Attorney, Agent, or Firm*—Richard S. Sciascia; Ervin F. Johnston; Thomas M. Phillips

[57] ABSTRACT

A system for locking a missile seeker to a desired target signal while the missile is in flight and approaching the target. The target is detected and tracked by a remote radar. The missile is launched and utilizes an inertial mid-course guidance to guide it in the general direction of the target. A data link is established between the remote radar and the missle seeker. When the missile is sufficiently close to the target its active radar is turned on and target information is transmitted via the data link to the remote radar or tracking station. The remote tracking station transmits back to the missile information for correcting its tracking course and provides information which effects missile seeker lock-on of the target of interest and will cause the missile seeker to continue to track the target until impact.

5 Claims, 7 Drawing Figures

REMOTE TARGETING SYSTEM FOR GUIDED MISSILES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to remote targeting systems for guided missiles and more particularly to remote targeting systems for guided missiles wherein a means is provided for the missile seeker to lock-on a desired target signal while the missile is in flight and approaching the target. This situation occurs especially in tactical situations where long stand off by the launch aircraft is advisable. Various systems have been devised for guiding a missile to its target which have the disadvantages of requiring the aircraft to carry a separate transmitter pod for range gate synchronization or of a beam riding type that would require the launch aircraft to close toward the target and participate continuously in the attack, or of having an operator through a command link control the seeker target gates until the missile reached the target. All of these systems are complex and costly with respect to the equipment required in the missile. The present invention provides a target acquisition system which is particularly applicable to a situation in which the target has been detected and is being tracked by pulsed radar. The missile utilizes an inertial mid-course phase, and the seeker is an active radar type with range and azimuth tracking circuits which lock-on the desired target echo signal.

The target is detected by an airborne or shipboard radar operator who places cursors over the desired target signal as it appears on a plan position indicator radar display. The radar, a small computer in the aircraft or ship, and a transponder including a guidance transfer unit carried in the missile then combine to determine the bearing and range of the desired target with respect to the missile as it flies in the general direction of the target. This information, together with a detailed breakdown of the range signature of the target is automatically transmitted to the missile through a small phase modulation of the radar pulse repetition frequency. The phase modulated signal is received at the missile and decoded by the guidance transfer unit. The bearing portion of the target information is fed from the guidance transfer unit to the missile autopilot to correct the missile heading to coincide with the actual bearing to the target at the time of acquisition by the missile seeker. Similarly the computed missile-to-target range and detail range signature data are fed to the missile seeker. The range data are used to position the seeker antenna properly in pitch and to turn on the missile transmitter at the appropriate distance from the target. The seeker utilizes the range and detail signature data to obtain lock-on of its range tracker to the specific target desired.

Accordingly, an object of the present invention is to provide a system for locking a missile to a desired target signal while the missile is in flight.

Other objects and many of the attendant advantages of this invention will be readily appreciated as the same becomes better understood by reference to the following detailed description when considered in connection with the accompanying drawings wherein.

Figure 1:
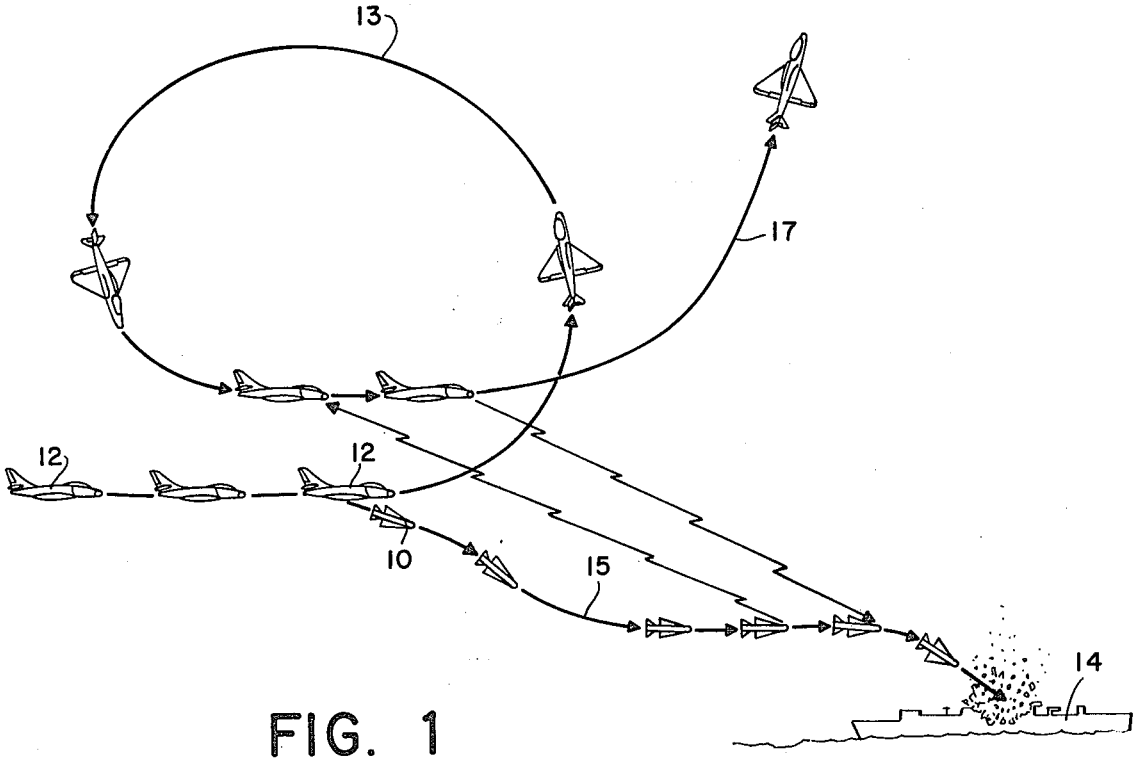
FIG. 1 shows a diagramatic representation of the sequence of operation in one illustrative embodiment of the invention.

Referring now to the drawings there is shown in FIG. 1 the general operational situation in which the remote targeting system is to function in carrying out the invention. An aircraft 12 carrying a missile 10 and having a tracking radar detects a target of interest 14. The aircraft 12 is then pointed toward target 14 and missile 10 is launched. Aircraft 12 veers off along path 13 and missile 10 eases down to preset altitude limit along path 15 and maintains an inertial course in azimuth at the preset altitude. Aircraft 12 returns for seeker acquisition phase so radar can detect both target 14 and missile 10. Missile 10 transmits its heading and range gate data for use by computer aboard aircraft 12 and corrected commands are returned via radar data link. With corrected heading and range information, seeker in missile 10 acquires target 14 and aircraft 12 is free to leave the area along path 17. Missile 10 continues tracking target 14 until there is a missile target encounter.

Missile 10 carries an active radar seeker which acquires the desired target. For purposes of explanation it is assumed that missile 10 is approaching at a constant altitude that is essentially the same as that of the target 14. It is understood that seeker tracking in the vertical plane as well as the horizontal plane may be required, but is not described since it would be a duplication of the elements described for azimuthal targeting.

Figure 2:
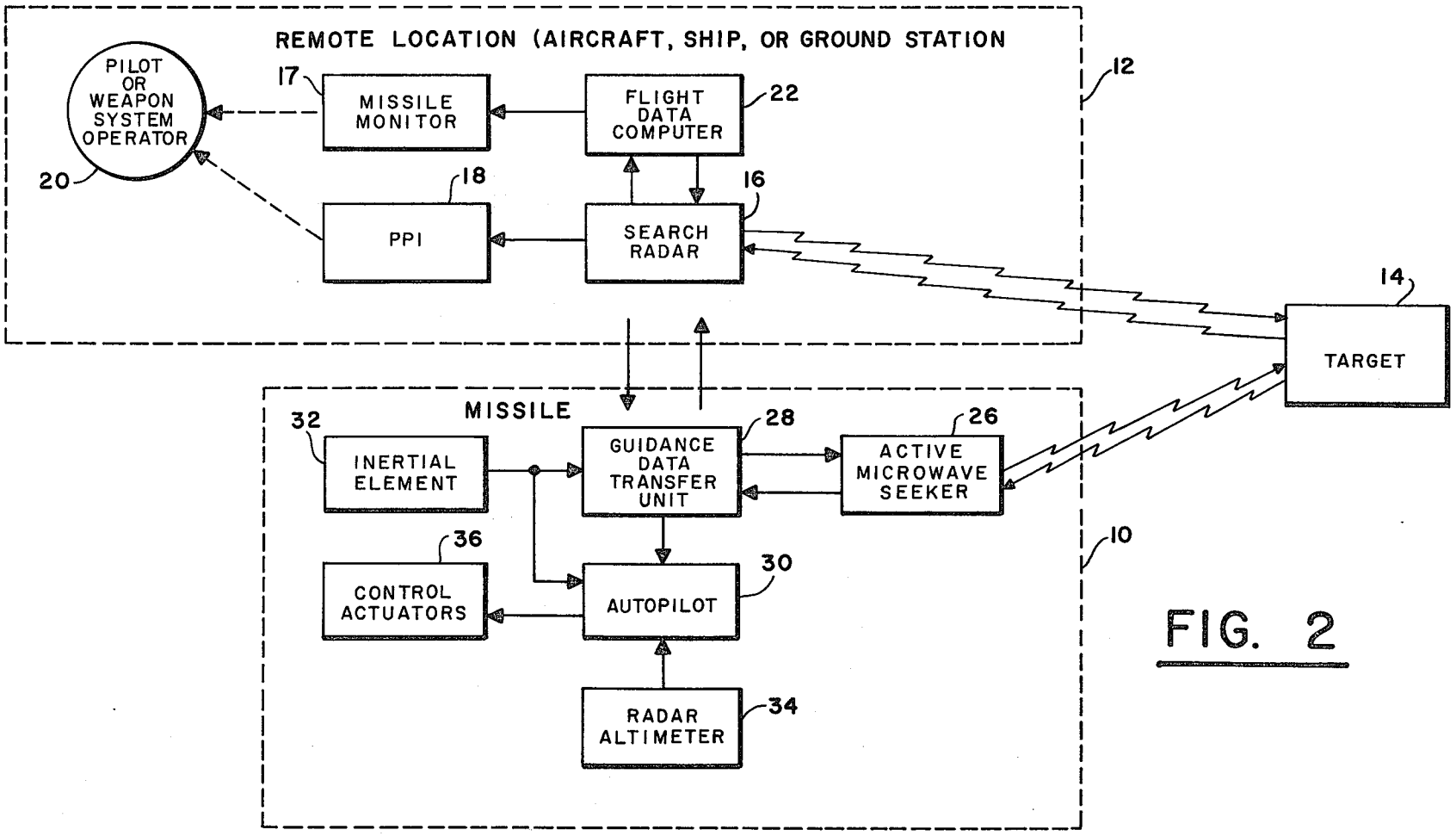
FIG. 2 is a block diagram of a preferred embodiment of the invention.

Referring now to FIG. 2 radar return signals from target 14 and other objects in the vicinity received by search radar 16 are displayed on a planned position indicator 18 which may be observed by the pilot or weapon system operator 20. Target range and bearing data are fed from search radar 16 to the flight data computer 22.

Located on missile 10 is an active microwave seeker 26 which is coupled to guidance data transfer unit 28 for transferring guidance data. Guidance data transfer unit 28 acts both as a transponder and transmits data received from seeker 26 to radar 16 located in aircraft 12. The necessary information is fed to autopilot 30 from guidance data transfer unit 28, inertial element 32, and radar altimeter 34 so that the appropriate control signals can be fed to control actuators 36.

Figure 4:
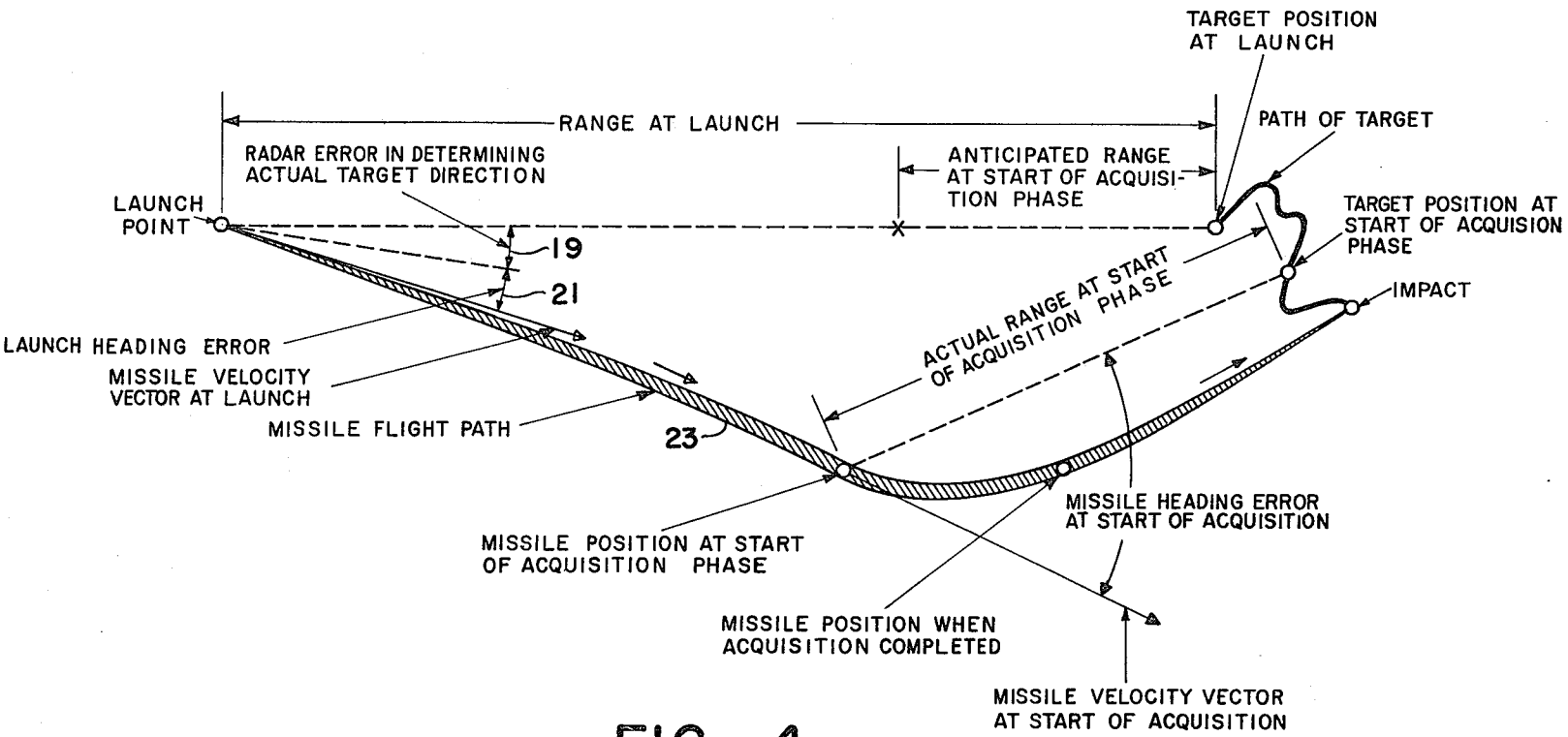
FIG. 4 is a diagram showing the missile yaw trajectory and corrections required.

When missile 10 has reached a point where acquisition can take place, the cumulative effects of a number of errors will generally result in the seeker being pointed in a direction other than that of the desired target (FIG. 4). The errors involved include the error in determining the true direction of the target prior to missile launch 19, the error in aligning the missile to the supposed target direction 21, positional error resulting from drift in the middle inertial element during mid-course flight 23, positional error due to unanticipated cross-winds, and the error brought about by target motion or deviation from the predicted target course during mid-course flight. These azimuthal errors together with a corresponding set of errors along the range axis, will cause the anticipated missile-to-target range to be in error.

To correct these errors the target is reacquired by search radar 16 located in aircraft 12 and the updated information is transferred to the seeker unit in the missile 10.

In operation radar 16 which may be of the pulse type operates in a sector scan mode which causes it to periodically scan in the direction of the target 14 and in the direction of missile 10. Radar return signals from target 14 and other objects in the vicinity are displayed on plan position indicator 18 and are viewed by an operator who selects the particular signal indicative of the desired target. The operator then operates controls on the plan position indicator which bring range and bearing cursors on the display into alignment with the target signal, and activates a switch which causes range and bearing tracking circuits to commence tracking the selected target. The tracking is performed in a track while scan mode. While this tracking is in process, radar 16 feeds target range and bearing data to flight data computer 22.

Figure 5:
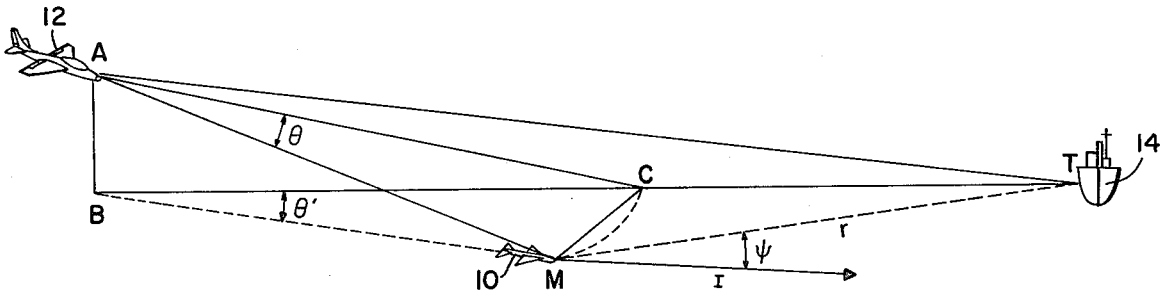
FIG. 5 is a diagram showing the trigometric steps required to determine missile-to-target range and missile heading correction.

In addition to tracking target 14, radar 16 periodically scans in the direction of missile 10 and the pulse signal from the transmitter of radar 16 is received by the guidance data transfer unit 28 in missile 10. Guidance data transfer unit 28 acts as a transponder and immediately emits toward radar 16 a pulse signal which, either by the microwave frequency or by other coding means, can readily be recognized as the return signal from missile 10. The return signals from missile 10 are automatically identified and tracked by radar 16. With both target and missile data available computer 22 can calculate the correct range (r) from missile 10 to target 14 and the correct heading ($\Psi$) of the target 10 with respect to a reference heading (I) originally set into inertial element 32. The trigometric steps for this calculation are shown in FIG. 5 where: B is a point on the surface directly beneath remote point A where search radar 16 and computer 22 are located. Point M is the location of missile 10 and Point T is the location of target 14. Line BCT is a straight line. Angle $\theta$ is the horizontal angle between Point M and Point T as measured by radar 16. Since angle $\theta$ is measured in the horizontal plane, angle $\theta$ is equal to angle $\theta'$. Lines AM and AT are missile and target ranges respectively, as measured by radar 16, and the line AB representing altitude is known from radar altimeter 34. Vector I is the missile horizontal heading set into missile 10 before launch. This initial bearing is retained by memory elements in both missile 10 and aircraft 12. By well known trigonometric means the corrected range (r) and heading ($\Psi$) can be computed.

Figure 6:
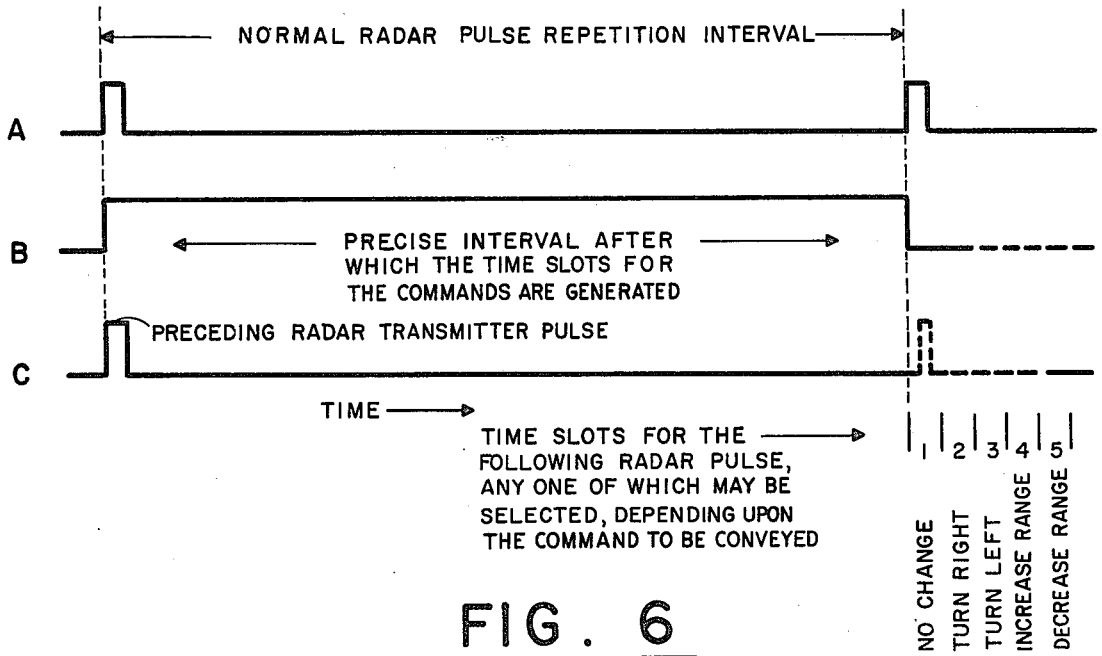
FIG. 6 is a graph of waveforms showing the method of transmission of commands.

The reference heading (I) set into missile 10 prior to launch would be the direction of target 14 if there were no mis-alignment, cross-winds, target motion, or other error producing factors present. Similarly, a range voltage (r') set into the missile 10 and decreased as a function of time or missile velocity would indicate the correct range from missile 10 to target 14 in the event that either there were no errors in the prelaunched missile flight predictions or all accumulated errors happened to cancel eath other. With errors probably present but with correct range (r) and heading correction ($\Psi$) data available at the remote location of radar 16 and computer 22, it is desirable to provide means to set range corrections ($r-r'$) and heading corrections ($\Psi$) to missile 10 in order for accurate target acquisition to be accomplished. In order to transmit correction signals to missile 10 from aircraft 12, small modulations in the exact timing of the radar transmitter pulse are used. These are illustrated in FIG. 6. A fixed precision time interval equal to the nominal pulse repetition cycle time is generated within the radar following each transmitted pulse. If, by means which will be described below, it is determined that no correction needs to be made in the heading (I) and range (r) set into missile 10, the succeeding radar transmitter pulse is emitted immediately following this fixed precision interval (position 1 of waveform C). If, however, a heading correction is necessary the succeeding transmitter pulse is delayed by a small amount (several microseconds) to a time slot that signifies a "turn right" command or to a slightly later slot that signifies a "turn left" command (i.e. positions 2 or 3 in waveform (C) of FIG. 6). Similarly commands to increase or decrease the range voltage (r') to provide accurate targeting are sent by use of further delay time slots (positions 4 or 5). If both heading and range corrections are necessary, the command signals can be interspersed in alternate transmission cycles. Additional time slots can be added to provide vernier command levels if desired. The time coded commands arrive at the missile each time the sector scanning radar scans in that direction, and are received and decoded by guidance data transfer unit 28. Range commands result in instrumental range corrections which are fed to the range voltage circuit in the missile seeker 26. Heading Commands are similarly processed to result in either a change in the missile heading through action of the missile autopilot, or a change in the azimuthal direction of the missile seeker antenna axis (which subsequently causes the change in the missile heading through the missile control action).

Figure 3:
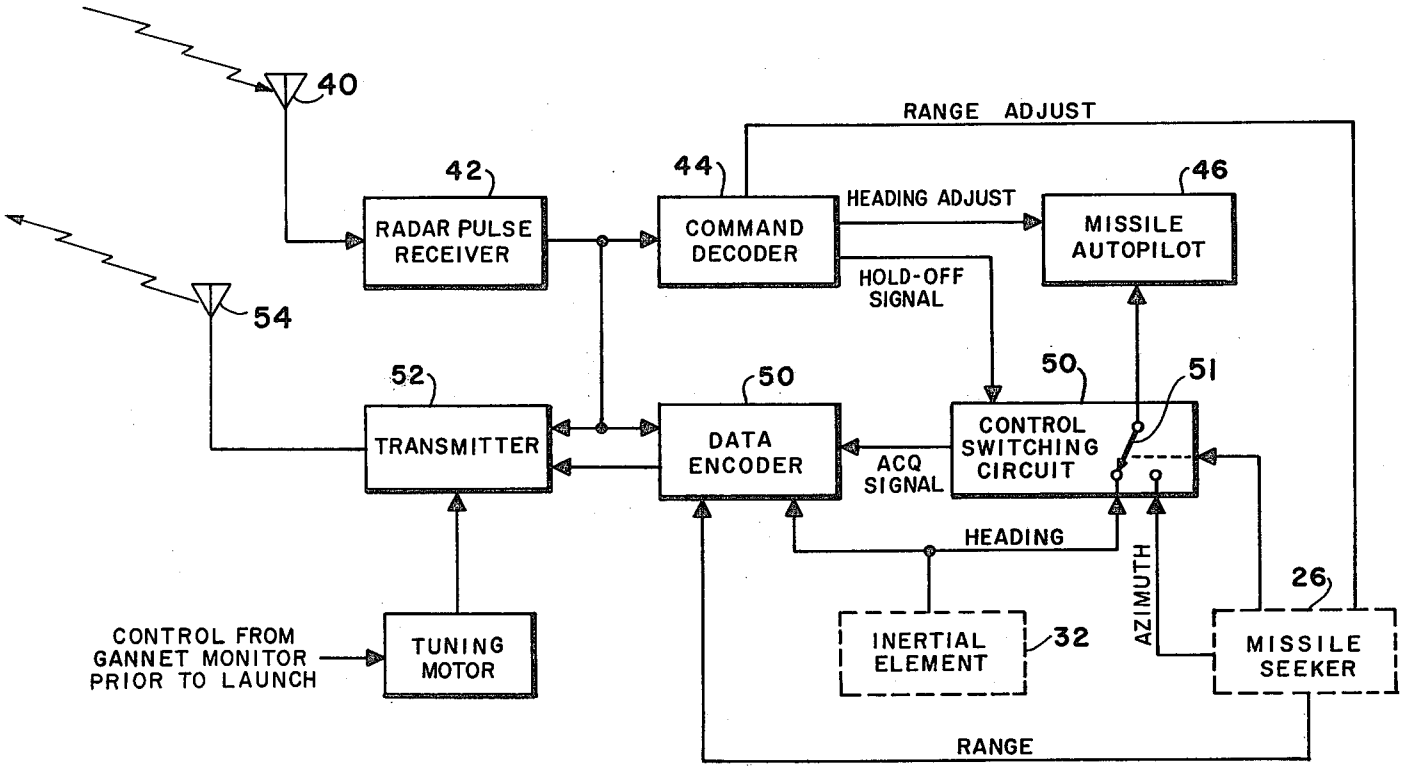
FIG. 3 is a block diagram of the guidance data transfer unit of FIG. 2.
Figure 7:
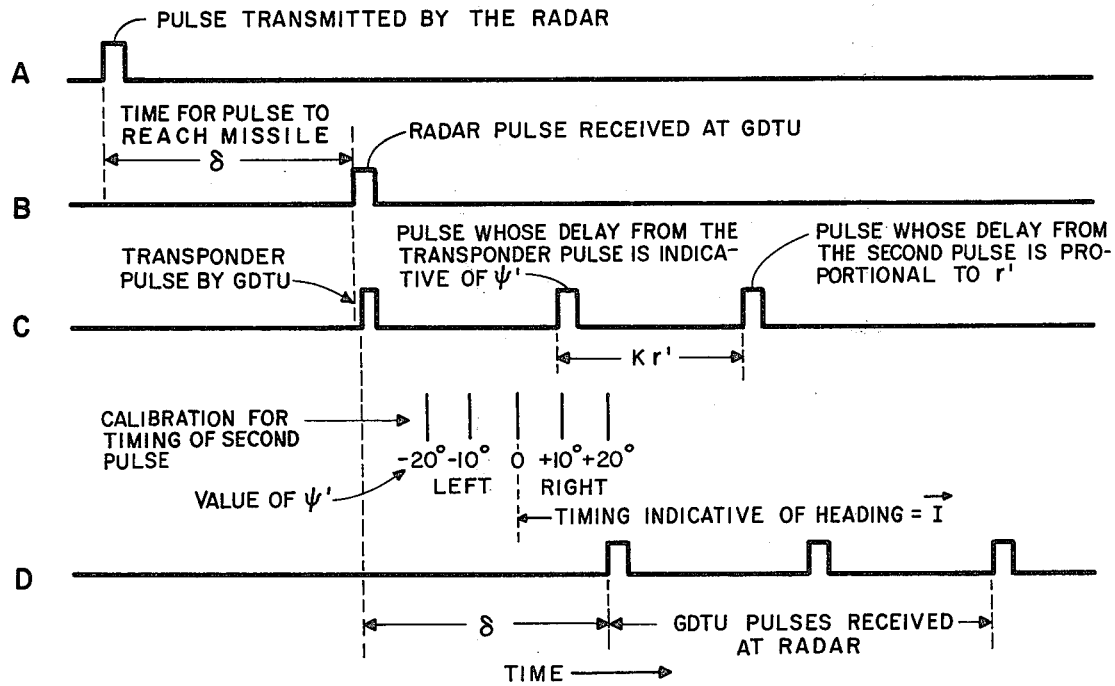
FIG. 7 is the graph of waveforms showing the method of data transfer to the radar from the guidance data transfer unit.

The above commands initiate a response by missile 10 to correct any errors in the heading or range voltage. However, to measure the extent to which the missile has responded to the initial commands and to correct any remaining errors in an accurate, closed loop manner, feedback from missile 10 via radar 16 to flight control computer 22 is provided. This feedback serves to keep computer 22 updated with respect to missile heading and range setting, and the updated computer can thus determine if and when further correction commands are needed. A diagram of a means for providing feedback from guidance data transfer unit 28 within the missile is included in FIG. 3 and the pulse timing involved in the feedback data transfer is shown in FIG. 7.

The heading portion of the feedback data comes to guidance data transfer unit 28 (FIG. 3) from mid-course inertial element 32 within the missile 10, which as described previously retains the reference (I) set into missile 10 prior to launch, and is able to measure the angle ($\Psi'$) to which the missile heading has been offset from the original inertial heading as result of the command actions. Data encoder 50 within the guidance data transfer unit 28 converts the inertial element potentiometer voltage representing $\Psi'$ to a pulse signal whose timing representing $\Psi'$ as illustrated in waveforms C and D of FIG. 7. Encoder 50 generates a pulse which follows the missile transponder pulse by a pre-established amount if $\Psi'=0$, or which follows by less or greater amount in proportion to $\Psi'$, if $\Psi'$ is not equal to zero. Arbitrarily, $\Psi'$ is taken to be positive if the missile heading is to the right of the reference sector I and negative if to the left of I. The $\Psi'$ pulse from encoder 50 triggers guidance data transfer unit 28 transmitter in the same manner as the transponder pulse, and this second pulse is received at the remote radar 16 where it is distinguishable because it has the same microwave frequency as the missile transponder pulse but is the second such pulse in the series. The remote flight data computer 22 determines the actual missile heading ($\Psi'$) from the pulse timing, compares this with the desired heading (c) and initiates additional commands until $\Psi'=\Psi$. Missile 10 is then directed accurately toward target 14.

Similar pulse delay modulation format is used for transferring the seeker range data (r') from the missile to the remote radar and flight control computer 22. Data encoder 50 uses the seeker range voltage from missile seeker 26 (or gating signal) to control the delay of a third transmitter pulse with respect to the second ($\Psi'$) pulse discussed above. This delay is made to be accurately proportional to the seeker range setting so that the remote flight data computer 22 will have the exact range at which seeker 26 is set to gate and accept a target echo signal. Computer 22 then generates the required command signals to make r' equal to r so that the desired target signal is selected once the missile closes range to the point where the target echo signal from the seeker transmitter pulse has increased in amplitude to a detectable level. For countermeasure reasons it may be undesirable to activate seeker 26 transmitter until it is possible to convert from the missile mid-course phase to the homing phase. A control switching circuit 50 within the guidance data unit serves this purpose. When seeker 26 has successfully acquired a target signal at the properly adjusted heading and range, a signal is supplied to control switching circuit 50 to actuate switch 51 to switch from the inertial signal being fed to the missile auto-pilot to the seeker azimuth signal. Still another function is that of providing the remote computer 22 and weapons system operator 20 with an indication that targeting has been successfully accomplished and the missile is in its homing phase. This is accomplished by providing a target acquired signal that results in a fourth pulse in the series returned from the guidance data transfer unit to the radar located in the aircraft 12.

Obviously many modifications and variations of the present invention are possible in the light of the above teachings. It is therefore to be understood that within the scope of the appended claims the invention may be practiced otherwise than as specifically described.

What is claimed is:

1. In a remote target system for guided missiles, the combination comprising:

(a) a radar located at a remote station for detecting and tracking a target, (b) a self-propelled guided missile launched from said remote station on a course established by said tracking radar, (c) said guided missile having seeker means for detecting and tracking said target, (d) a guidance data transfer unit coupled to said missile seeker for transferring guidance data between said missile seeker and said tracking radar, (e) said missile seeker being responsive to guidance information received from said tracking radar for acquiring and locking-on said target in a homing mode, (f) said guidance data transfer unit including a control switching unit for transferring guidance information supplied for the guidance of said missile from the pre-established course to guidance information supplied by said missile seeker in response to a command signal from said tracking radar.

2. The system of claim 1 wherein said tracking radar is a pulsed search radar.

3. The system of claim 2 wherein target tracking information is automatically transmitted to said missile by phase modulation of the pulse repetition frequency of said tracking radar.

4. The system of claim 3 wherein said guidance data transfer unit has means for decoding said phase modulated information signals.

5. The system of claim 4 wherein said guidance data transfer unit includes means for transmitting the corrected guidance data to the radar to form a data transfer closed loop.

* * * * *